United States Patent [19]

Boots

[11] 4,215,887

[45] Aug. 5, 1980

[54] HAND OPERATED PICKUP DEVICE FOR DEPOSITED MATERIAL

[76] Inventor: Vernie A. Boots, P.O. Box 456, Belle Glade, Fla. 33430

[21] Appl. No.: 947,393

[22] Filed: Oct. 2, 1978

[51] Int. Cl.[3] ..... A01K 29/00

[52] U.S. Cl. ..... 294/1 BA

[58] Field of Search ..... 294/1 B, 1 BA, 16, 19 R, 294/28, 118; 15/104.8, 257.1, 257.4, 257.6, 257.7; 248/95, 97, 99

[56] References Cited

U.S. PATENT DOCUMENTS

| | | | |
|---|---|---|---|
| 3,374,026 | 3/1968 | Coleman | 294/28 X |
| 3,446,525 | 5/1969 | Jones | 294/1 BA |
| 3,659,816 | 5/1972 | Wilson | 248/97 |
| 3,767,247 | 10/1973 | Wetzler | 15/104.8 X |
| 3,960,351 | 6/1976 | Coetzee | 248/97 |

*Primary Examiner*—Johnny D. Cherry

[57] ABSTRACT

A pickup device of highly functional yet inexpensive construction, comprising a pair of loop-shaped portions that are hinged together, with the loop-shaped portions being movable to a widely separated position such that an inverted bag that has been partially turned inside out may be inserted between the loops. Handle portions located above the hinge locations are able to be grasped by the user and brought together, with such action serving to bring base portions of the loops, as well as certain neck portions of the bag, together. This action makes my device readily adaptable for the picking up of material from a floor or sidewalk, such as that deposited by an animal, with this arrangement advantageously serving to cause the removed material to be enveloped in the bottom portion of the bag, with the upper portions of the bag thereafter being easily brought together and tied, and with the exterior of the bag and the pickup device remaining unsoiled throughout the entire procedure.

3 Claims, 7 Drawing Figures

HAND OPERATED PICKUP DEVICE FOR DEPOSITED MATERIAL

BACKGROUND OF THE INVENTION

In the past, a number of devices have been proposed for enabling a pet owner to clean up a floor or sidewalk after the animal has defecated. These devices have taken the form of scoops, brushes, tongs, and even various forms of bagging arrangements.

Unfortunately, in all known instances, the use of such devices has been a particularly unpleasant task, and by the time the material deposited by the animal has been bagged, the outside of the bag has been smeared or defiled, thereby making subsequent handling of the bag a delicate job and causing it to be an immediate goal of the pet owner to find an appropriate receptacle in order that he can rid himself of the bag as quickly as possible.

It was the desire to provide an inexpensive and highly satisfactory improvement over such prior art devices that the present invention was evolved.

SUMMARY OF THE INVENTION

A novel pickup device in accordance with this invention is a hand-operated device that is particularly adapted for use with a small inverted bag that has partially been turned inside out. My device includes first and second loops of generally U-shaped configuration, with each of the loops having a flat base portion, as well as an elongate upstanding leg at each end of said base portion. Each pair of legs extends upwardly so as to form a respective handle, with the legs of one U-shaped member being hinged with the leg of the other U-shaped member at a location between the base portions and the handles. Therefore, when the handles are grasped in the hand of the user and brought together, the base portions of the U-shaped members will be brought together in a most functional way.

The first and second loops, when in a spread apart position, have their base portions adapted to receive an inverted bag turned partially inside out, with the bottom of the inverted bag residing in the general vicinity of the hinges, and with the sides of the bag near the outlet of the bag residing outside the legs.

In operation, my device in a wide stance position is fitted with a bag of paper or plastic, with the base portions of the loops then being placed such that they span the material to be picked up from floor, sidewalk or grass. As should be apparent, the mid portions of the bag cover the base portions of the loops, such that they are not soiled at such time as the handles are manipulated to cause the base portions to come together. The covered base portions serve to effectively separate the material from the supporting surface, with the material being caused by the base portions approaching each other, to move upwardly toward the bottom of the inverted bag. The bagging operation is completed by the user thereafter bringing the sides of the bag away from the legs of the U-shaped portion, with the neck of the bag then being tied in order to complete the encapsulation of the material. Significantly, the exterior of the bag has remained unsoiled throughout the entire procedure.

A primary object of my invention is to provide a hand-operated pickup device of simple yet highly effective construction, by means of which a person can easily and quickly remove material from a floor or sidewalk, such as that deposited by an animal, with such being accomplished in a sanitary and non-offensive manner.

Another object of my invention is to provide a pickup device designed for use with an inverted bag of ordinary construction, with inner portions of the bag being brought into contact with material to be removed from a floor or sidewalk by the operation of my device, such that the material is caused to be encapsulated in the bag, and with the pickup device as well as the hands of the user and the bag exterior remaining unsoiled throughout the whole procedure.

It is yet another object of my invention to provide a pickup device having a pair of loops of generally U-shaped configuration, with one of the loops being slightly larger than the other and with the loops being adapted to receive thereon an inverted bag that has been partially turned inside out, with the smaller of the loops being designed to pass through the larger loop at such time as the handles of the device are brought together, with this loop action serving to close the bag subsequent to the pickup of material from a floor or sidewalk.

These and other objects, features and advantages will become more apparent as the description proceeds.

DETAILED DESCRIPTION

Figure 1:
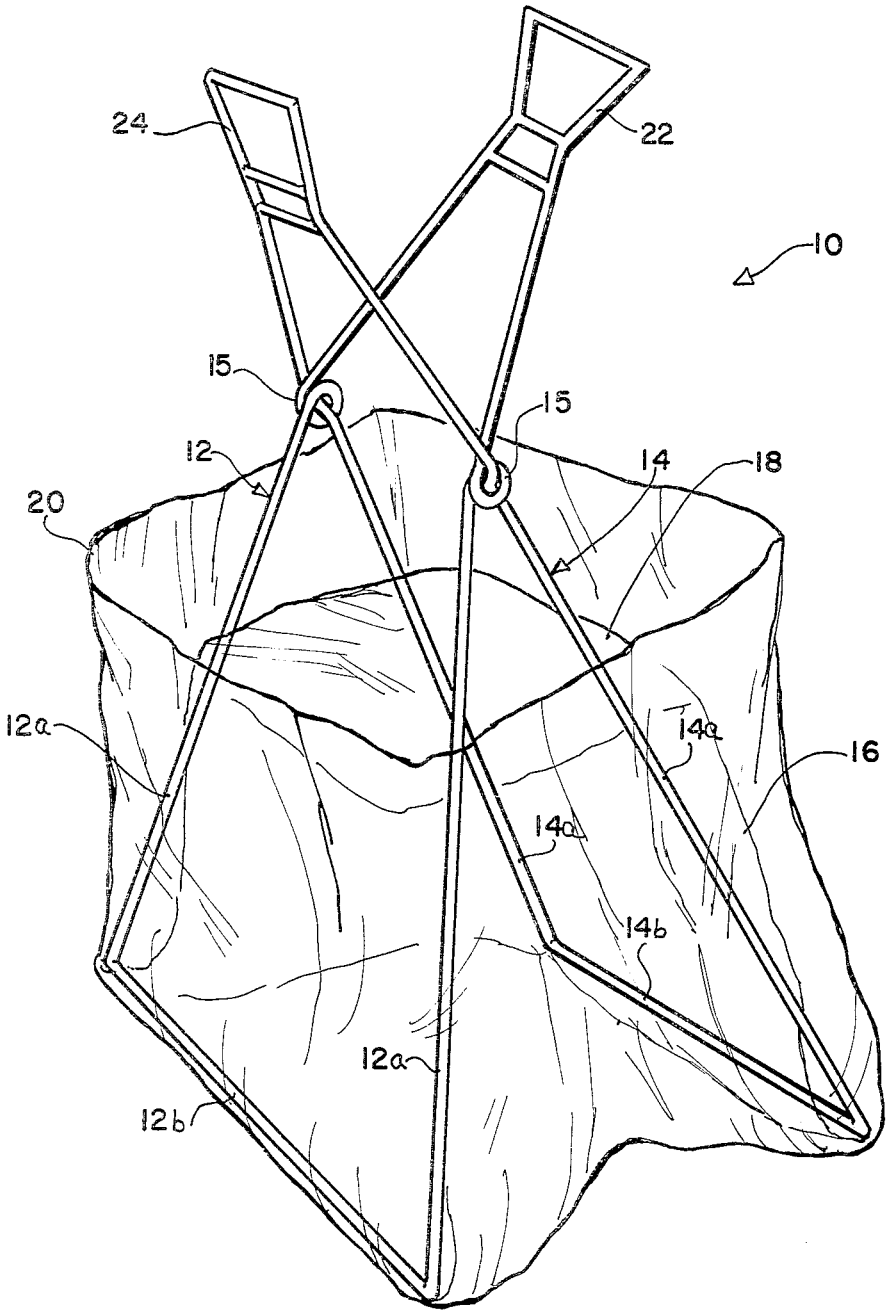
FIG. 1 is a perspective view of my novel hand-operated pickup device shown in the operative position, utilizing an inverted bag partially turned inside out.

Turning to FIG. 1, it will there be seen that my novel hand-operated pickup device is principally made up of first and second U-shaped loops 12 and 14 of generally U-shaped configuration, with these preferably being made up of wire such as semihard 12 gauge wire. However, I am not to be so limited, and other suitable techniques may also be used in the construction of a device in accordance with my invention.

As will be noted, loop 12 is made up of a pair of substantially parallel legs 12*a*, which are connected by a base portion 12*b*, with the base portion being essentially uncurved and able to be put into close contact with a flat surface. Similarly, U-shaped loop 14 is made up of a pair of generally parallel legs 14*a*, which legs are interconnected by means of straight base portion 14*b*. The base portions 12*b* and 14*b* remain essentially parallel to each other at all times.

Each pair of legs extends upwardly so as to form a respective handle, with handle 22 being directly associated with U-shaped loop 12, and handle 24 being directly associated with U-shaped loop 14. Preferably, a single piece of wire is suitably bent so as to form the legs, the base member, and the respective handle member of each half of the device, but I am not to be limited to this. As will be noted from FIG. 1 and other figures, the two U-shaped loops are hinged together at 15, with the hinges for example being made by forming appropriate loops of small size in the upper part of one pair of legs. Alternatively, however, the hinges may be in the form of add-on components of metal, plastic, or the like.

As a result of this construction, when the handles 22 and 24 are grasped and brought together by the user, the base portions of the U-shaped members will come together. Conversely, when the handles are spread apart to the position depicted in FIG. 1, this causes the loops to be moved to the wide stance position.

Figure 2:
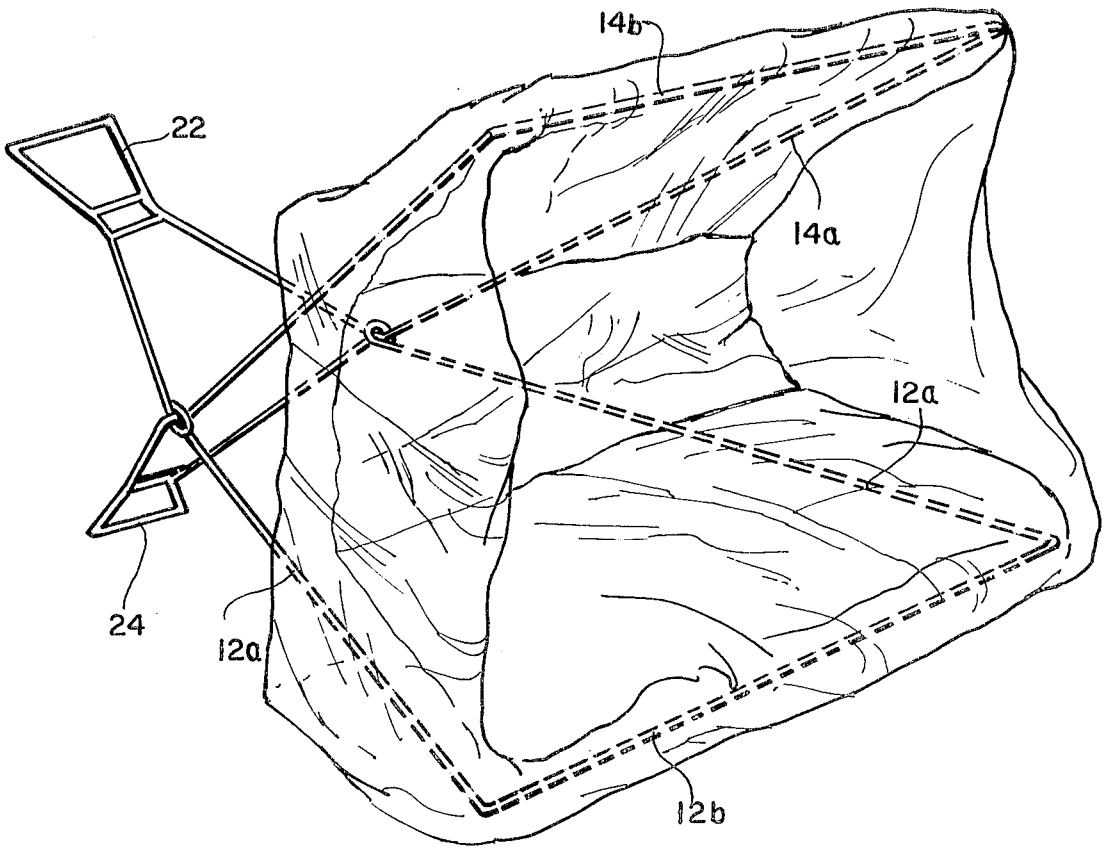
FIG. 2 is a perspective view generally similar to FIG. 1, but turned so as to enable the underside of the device and the bag interior to be viewed.

As will be noted from a study of FIG. 1 and FIG. 2, the U-shaped members, when in the spread apart position, serve to easily receive a small inverted bag 16, such as of plastic, paper, or the like. It is important to note that the base or bottom portion 18 of the bag 16 is disposed in the general vicinity of the hinges 15, whereas the perimeter portion 20 normally associated with the upper open edge of the bag is disposed on the opposite or outer portions of the legs of the U-shaped member, as compared with the bottom of the bag. In other words, the inverted bottom portion of the bag resides between the legs of the U-shaped members, whereas approximately the upper half of the bag is folded around the outer portion of the four legs at the time my device is to be put into use. As will be noted in the two mentioned figures as well as in related FIGS. 3*a* through 3*d*, when the bag has been deployed about the U-shaped loops in the manner described, it is in a position to pick up material from a sidewalk, floor, or even from a surface such as grass or turf.

Figure 3D:
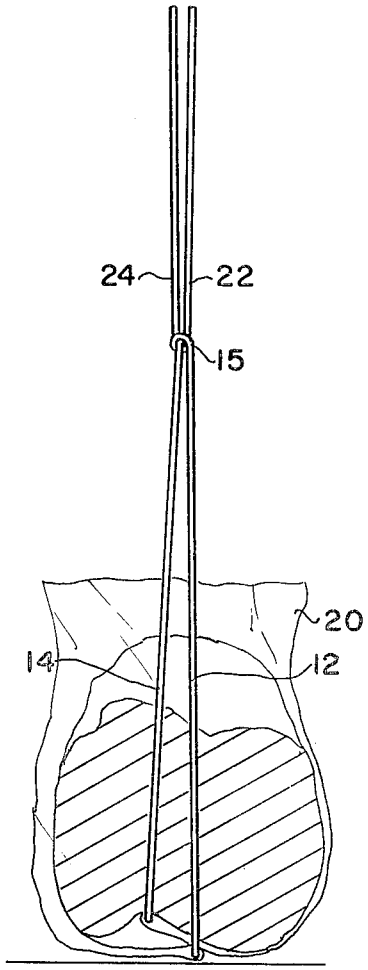
FIGS. 3*a* through 3*d* reveal by a succession of views, how my device is operated so as to remove material from a floor or sidewalk in a sanitary manner, with this resulting in the automatic bagging of the material.
Figure 3C:
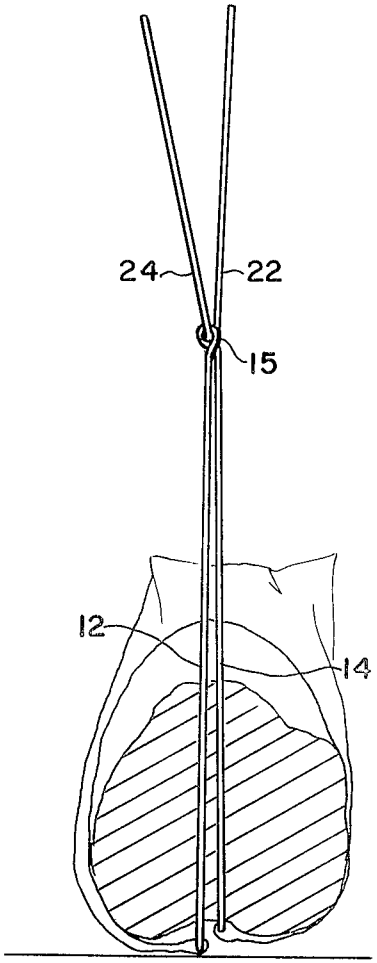
Figure 3B:
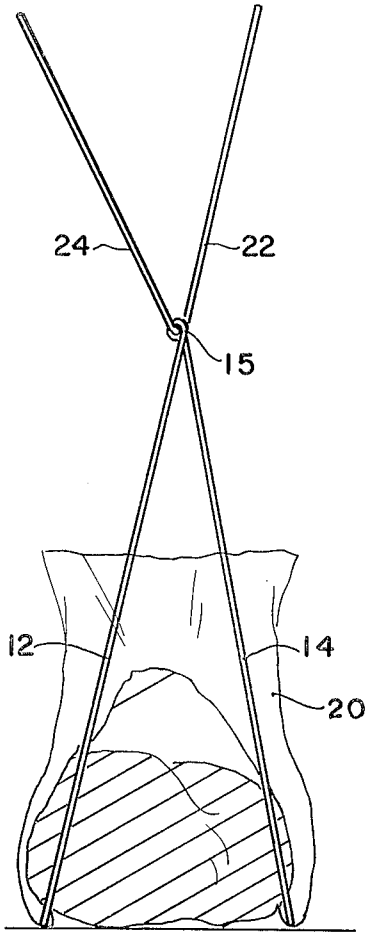
Figure 3A:
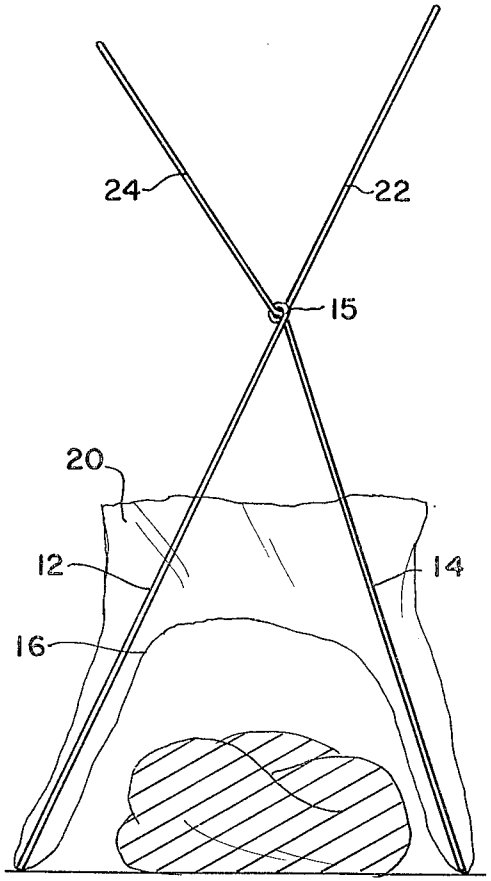

Referring specifically to FIG. 3*a*, it is to be understood that when the loops have been moved to the spread apart position after an inverted bag has been installed thereon, the device is ready to be placed over material to be picked up. The user now grasps the handles 22 and 24 and then starts bringing the handles together. This action causes the base portions 12*b* and 14*b* to move toward each other in the manner shown in FIG. 3*b*, with these in turn causing the mid portion of the bag adjacent the base portions to start moving between the excrement and the supporting surface. In this manner the excrement is separated from the floor, sidewalk or other surface upon which it may rest, and this causes the material to be reshaped so as to move upwardly, which in this instance is in the direction of the bottom 18 of the bag.

FIG. 3*c* reveals the loops just before they pass, with it there being apparent that first loop 12 in this embodiment is sufficiently larger than second loop 14 as to enable the base portion 12*b* of loop 12 to pass under base portion 14*b* of loop 14, and in so doing effecting a closure of the bag around the excrement or other material. It is to be noted that the handle portion 24 is preferably not co-planar with the U-shaped loop 14, this being true for a reason about to become apparent.

FIG. 3*d* shows the position of the U-shaped loops after the handles have been brought together, and at this point it will be noted that the second loop 14 has moved well inside and beyond the first loop 12, and in so doing causing the inner fold of the bag contacted by loop 14 to move inside the inner fold of the bag located in the immediate vicinity of the U-shaped member 12. The material is now completely encapsulated, thus making it an easy task for the pet owner to readily dispose of the bag and its contents. It is most important to note that the portion of the bag that is to be regarded as the exterior has remained unsoiled during this entire procedure.

Figure 4:
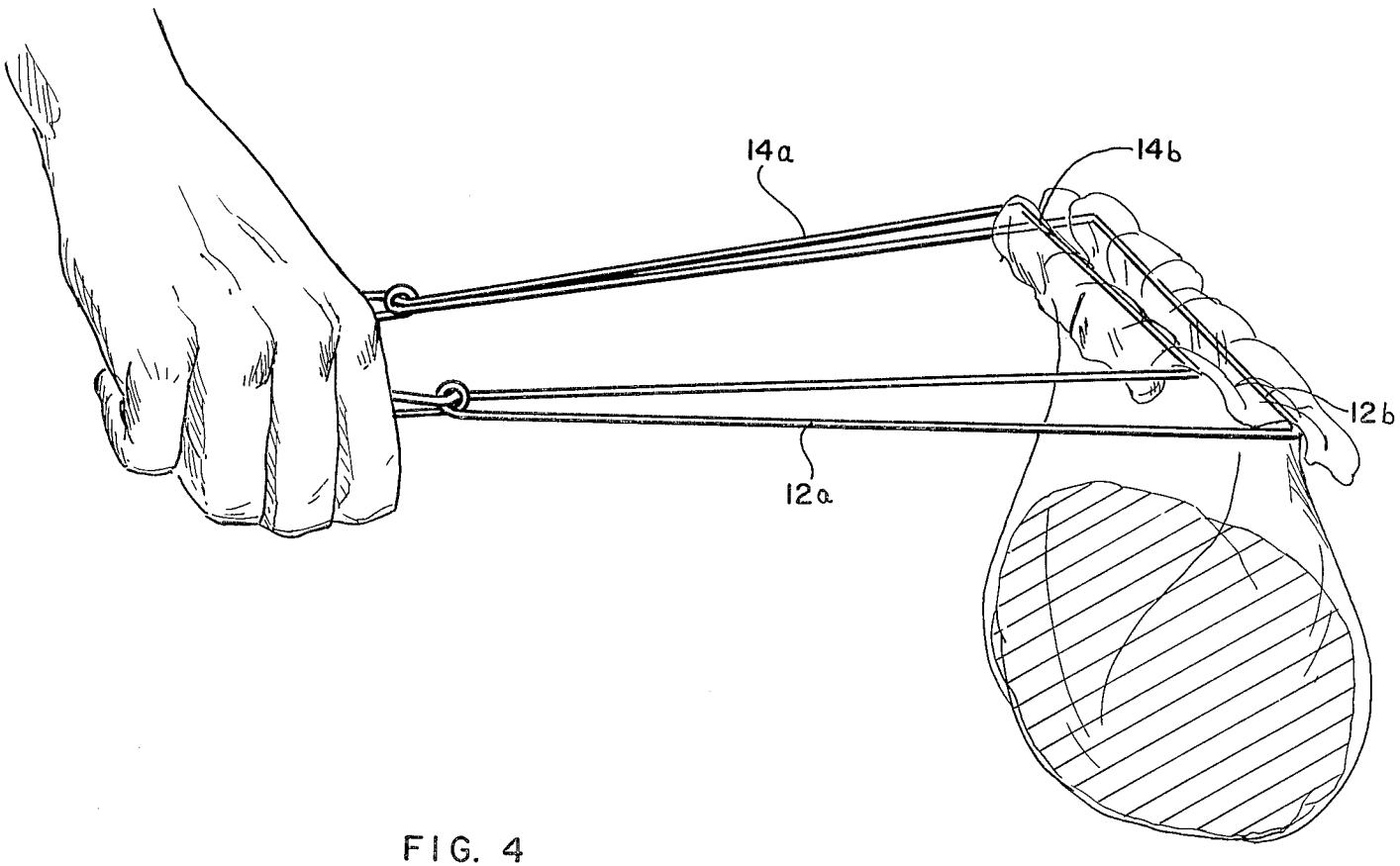
FIG. 4 is a view showing the hand of a user grasping the handles subsequent to the completion of a pickup operation, with the removed material having been bagged without soiling the exterior of the bag.

Turning to FIG. 4, the user has turned my device sideways preparatory to release of the bag for disposal purposes. If the material in the bag is sufficiently heavy, the bottom of the bag will start to move downwardly of its own accord as soon as handle pressure is released somewhat, whereas in other instances it may be desirable for the user to assist the separation procedure by peeling the upper portion 20 of the bag away from the legs. As soon as the bag has been separated from the loops, the neck of the bag is tied such as with string, twisted wire, or the like.

Although I prefer for one of the loops to be smaller than the other so that it will pass through the other, I am not to be limited, and if desired, the loops can be made approximately the same size.

My novel and highly advantageous device can be manufactured inexpensively, used readily without detailed instruction being necessary, and can be stored in a small space when not in use.

I claim:

1. A pickup device particularly adapted for use with a small inverted bag, said device having first and second loops of generally U-shaped configuration, with the base portion of each loop being essentially flat, and with an upstanding leg located at each end of each base portion, each pair of legs extending upwardly so as to form a handle, with the legs of one U-shaped member being hinged with the legs of the other U-shaped member at a location between the base portions and the handles, such that when the handles are grasped and brought together by the user, the base portions of the U-shaped members will be brought together, said loops being adapted to receive an inverted bag turned partially inside out, said device then being adapted to be placed over material to be picked up, with the open portion of the inverted bag being disposed directly over the material, said handles, when brought together by the user, causing the base portions of the loops to be brought together so as to separate the material from the floor or sidewalk upon which it rests, with this action serving to entrap the material inside the bag, said first loop being larger than said second loop, with said second loop being adapted to pass through said first loop at the time handles are brought together, with such serving to effect a closure of the bag, so that the contents will not be inadvertently spilled.

2. A pickup device particularly adapted for use with a small inverted bag, said device having first and second loops of generally U-shaped configuration, with the base portion of each loop being essentially flat, and with an upstanding leg located at each end of each base portion, each pair of legs extending upwardly so as to form a handle, with the legs of one U-shaped member being hinged with the legs of the other U-shaped member at a location between the base portions and the handles, such that when the handles are grasped and brought together by the user, the base portions of the U-shaped members will be brought together, said loops, when in the spread apart position, having their base portions adapted to receive an inverted bag turned partially inside out, said device being adapted to receive the bottom of the inverted bag between the legs of the loops, with the sides of the bag near the outlet of the bag residing outside the legs, said device then being adapted to be placed over material to be picked up off a floor or sidewalk, with the base portions in such instance residing on either side of the material, and with the open portion of the inverted bag being disposed directly over the material, said handles, when brought together by the user, causing the base portions of the loops to be brought together so as to separate the material from the floor or sidewalk upon which it rests, with this action serving to entrap the material inside the bag, the upper sides of the bag then being removable from the leg portions and thereafter tied together, with the exterior of the bag and the device remaining unsoiled throughout the procedure, said first loop being larger than said second loop, with said second loop being adapted to pass through said first loop at the time said handles are brought together, with such serving to effect a closure of the bag.

3. A pickup device particularly adapted for use with a small inverted bag, said device having first and second loops of generally U-shaped configuration, each of said loops having a flat base portion, as well as an elongate leg on each end of said base portion, with the legs of one loop being hinged to the legs of the other loop, and with the legs thereafter continuing beyond the hinge locations to form handle portions at locations remote from the base portions, said handles being adapted to being grasped by the hand of the user and brought together, with this action causing the base portions of the loops to be brought together, said loops, when the base portions are in the spread apart position, being adapted to receive an inverted bag that has been partially turned inside out, with the bottom of the bag residing between the legs, and the outer edge portions of the bag residing outwardly of the legs, said device then being adapted to be placed over material to be picked up off of a floor, lawn, or sidewalk, with the base portions residing on either side of the material and with the open portion of the inverted bag directly over the material, said handles, when brought together by the user, causing the base portions of the loops to be brought together and in that way to separate the material from the surface upon which it rests, with this action serving to entrap the material inside the bag, with the upper sides of the bag then being removed from the leg portions preparatory to the neck of the bag being tied, with the exterior of the bag remaining unsoiled throughout the procedure, one of said loops being larger than the other, with such other loop member being adapted to pass through said one loop at such time as the handles are brought together, with such serving to effect a closure of the bag.

* * * * *